US008579644B2

(12) United States Patent
Cole et al.

(10) Patent No.: US 8,579,644 B2
(45) Date of Patent: Nov. 12, 2013

(54) ANTI-VIBRATION CONNECTOR COUPLING WITH DISENGAGEMENT FEATURE

(75) Inventors: Patrick M. Cole, Oneonta, NY (US); Ryan C. Wade, Endicott, NY (US); Richard L. Barnes, Unapilla, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/418,617

(22) Filed: Mar. 13, 2012

(65) Prior Publication Data

US 2013/0244466 A1 Sep. 19, 2013

(51) Int. Cl.
*H01R 13/62* (2006.01)

(52) U.S. Cl.
USPC ..... 439/312

(58) Field of Classification Search
USPC ..... 439/310–312, 320–323
See application file for complete search history.

(56) References Cited

U.S. PATENT DOCUMENTS

| | | | | |
|---|---|---|---|---|
| 2,728,895 | A | 12/1955 | Quackenbush et al. | |
| 2,958,723 | A | 11/1960 | Logan et al. | |
| 3,184,535 | A | 5/1965 | Worthington | |
| 3,601,764 | A | 8/1971 | Cameron | |
| 3,917,373 | A | 11/1975 | Peterson | |
| 4,208,082 | A | 6/1980 | Davies et al. | |
| 4,268,103 | A | 5/1981 | Schildkraut et al. | |
| 4,291,933 | A | 9/1981 | Kakaris | |
| 4,359,254 | A | 11/1982 | Gallusser et al. | |
| 4,472,013 | A | 9/1984 | Frear | |
| 4,501,927 | A | 2/1985 | Sievert | |
| 4,506,942 | A | 3/1985 | Flederbach et al. | |
| 4,588,245 | A | 5/1986 | Schwartz et al. | |
| 4,629,272 | A | 12/1986 | Mattingly et al. | |
| 4,820,184 | A | 4/1989 | Brandes | |
| 4,829,272 | A * | 5/1989 | Kameya | 333/139 |
| 4,944,699 | A | 7/1990 | Velke, Sr. et al. | |
| 4,971,501 | A | 11/1990 | Chavez | |
| 5,074,703 | A | 12/1991 | Dawson | |
| 5,188,398 | A | 2/1993 | Parimore, Jr. et al. | |
| 5,199,894 | A | 4/1993 | Kalny et al. | |
| 5,278,354 | A | 1/1994 | Lhomme | |
| 5,315,065 | A | 5/1994 | O'Donovan | |
| 5,378,855 | A | 1/1995 | Delalle | |
| 5,399,096 | A | 3/1995 | Quillet et al. | |

(Continued)

FOREIGN PATENT DOCUMENTS

| | | |
|---|---|---|
| EP | 0 247 814 | 12/1987 |
| EP | 0 311 338 | 4/1989 |
| EP | 0 535 867 | 4/1993 |
| JP | 2000-019329 | 3/1995 |

*Primary Examiner* — Jean F Duverne
(74) *Attorney, Agent, or Firm* — Blank Rome LLP

(57) ABSTRACT

A connector coupling that comprises a connector body, a first collar that receives the connector body, and second collar that surrounds the first collar. A movable ratchet ring is supported by the connector body and includes at least one locking member. The movable ratchet ring is axially movable with respect to the first collar between engaged and disengaged positions. A stationary ratchet ring is coupled to the first collar and includes at least one locking member. When the movable ratchet ring is in the engaged position, the locking members of the rings are engaged, and rotating the second collar from the first position to the second position with respect to the first collar moves the movable ratchet ring to the disengaged position away from the stationary ratchet ring such that the locking members are disengaged, thereby allowing rotation of the first collar with respect to the connector body.

21 Claims, 7 Drawing Sheets

(56) References Cited

U.S. PATENT DOCUMENTS

| | | | | |
|---|---|---|---|---|
| 5,435,760 | A | 7/1995 | Miklos | |
| 5,447,447 | A | 9/1995 | Guss, III et al. | |
| 5,458,501 | A | 10/1995 | Lazaro, Jr. et al. | |
| 5,580,278 | A | 12/1996 | Fowler et al. | |
| 5,618,200 | A | 4/1997 | Norgaard | |
| 5,653,605 | A * | 8/1997 | Woehl et al. | 439/321 |
| 5,674,087 | A | 10/1997 | Kirma | |
| 5,749,756 | A | 5/1998 | Vockroth et al. | |
| 5,957,716 | A | 9/1999 | Buckley et al. | |
| 5,971,787 | A | 10/1999 | Brown | |
| 6,086,400 | A | 7/2000 | Fowler | |
| 6,123,563 | A | 9/2000 | Johnson et al. | |
| 6,293,595 | B1 | 9/2001 | Marc et al. | |
| 6,602,085 | B2 * | 8/2003 | Young et al. | 439/321 |
| 6,976,889 | B2 | 12/2005 | Kuwayama et al. | |
| 7,032,931 | B2 * | 4/2006 | Austin | 285/92 |
| 7,160,156 | B2 | 1/2007 | Holliday | |
| 7,544,085 | B2 * | 6/2009 | Baldwin et al. | 439/471 |
| 7,905,741 | B1 | 3/2011 | Wade et al. | |
| 7,914,311 | B1 | 3/2011 | Gallusser et al. | |
| 2002/0058437 | A1 | 5/2002 | Young et al. | |

* cited by examiner

ANTI-VIBRATION CONNECTOR COUPLING WITH DISENGAGEMENT FEATURE

FIELD OF THE INVENTION

The present invention relates to anti-vibration coupling for an electrical connector that prevents counter-rotation and loosening of the electrical connector due to vibration when engaged with its mating connector. More specifically, the invention relates to an anti-vibration coupling that incorporates a disengagement feature allowing manual unlocking of the electrical connector and its mating connector.

BACKGROUND OF THE INVENTION

Electrical connector assemblies generally include mating plug and receptacle connectors. Often a threaded nut or collar is used to mate the plug and receptacle connectors. When an electrical connector assembly is subject to vibration or shock, however, the mating connectors of the assembly, often become loose or even decouple. The loosening or decoupling usually occurs because the coupling nut counter rotates, that is it rotates in a direction opposite the mating or locking direction, thereby compromising the integrity of both the mechanical and electrical connection between the plug and receptacle connectors.

Therefore, a need exists for an anti-vibration coupling that both prevents loosening of the mated plug and receptacle but also provides a mechanism for easily disengaging the plug and receptacle when desired.

Examples of some prior art couplings for electrical connector assemblies include U.S. Pat. No. 7,914,311 to Gallusser et al.; U.S. Pat. No. 7,905,741 to Wade et al., U.S. Pat. No. 6,293,595 to Marc et al.; U.S. Pat. No. 6,123,563; U.S. Pat. No. 6,086,400 to Fowler; U.S. Pat. No. 5,957,716 to Buckley et al.; U.S. Pat. No. 5,435,760 to Miklos; U.S. Pat. No. 5,399,096 to Quillet et al.; U.S. Pat. No. 4,208,082 to Davies et al.; U.S. Pat. No. 3,917,373 to Peterson; and U.S. Pat. No. 2,728,895 to Quackenbush, the subject matter of each of which is hereby incorporated by reference.

SUMMARY OF THE INVENTION

The present invention generally provides a connector coupling that comprises a connector body, a first collar that has opposite first and second ends and that receives the connector body, and a second collar that surrounds the first collar and that is rotatable with respect to the first collar between first and second positions. A movable ratchet ring is supported by the connector body and includes at least one locking member. The movable ratchet ring is axially movable with respect to the first collar between engaged and disengaged positions. A stationary ratchet ring is coupled to the first collar and includes at least one locking member corresponding to the at least one locking member of the movable ratchet ring. When the movable ratchet ring is in the engaged position, the locking members of the movable and stationary ratchet rings are engaged. Rotating the second collar from the first position to the second position with respect to the first collar moves the movable ratchet ring to the disengaged position away from the stationary ratchet ring such that the locking members are disengaged, thereby allowing rotation of the first collar with respect to said connector body.

The present invention may also provide a connector coupling that comprises a connector body, a first collar that has opposite first and second ends and that receives the connector body, and a second collar that surrounds the first collar and that is rotatable with respect to the first collar between first and second positions. The second collar includes a disengaging member at an end thereof that defines a receiving area. A movable ratchet ring is supported by the connector body and includes at least one locking member. The movable ratchet ring is axially movable with respect to the first collar between engaged and disengaged positions. The movable ratchet ring is in contact with the disengaging member of the second collar when in the disengaged position. A stationary ratchet ring is coupled to the first collar and includes at least one locking member corresponding to the at least one locking member of the movable ratchet ring. The stationary ratchet ring is received in the receiving area of the second collar when the second collar is in the second position. When the second collar is rotated from the first position to the second position with respect to the first collar moves the movable ratchet ring to the disengaged position via the disengaging member of the second collar pushing the movable ratchet ring away from the stationary ratchet ring such that the locking members are disengaged, thereby allowing rotation of the first collar with respect to the connector body.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
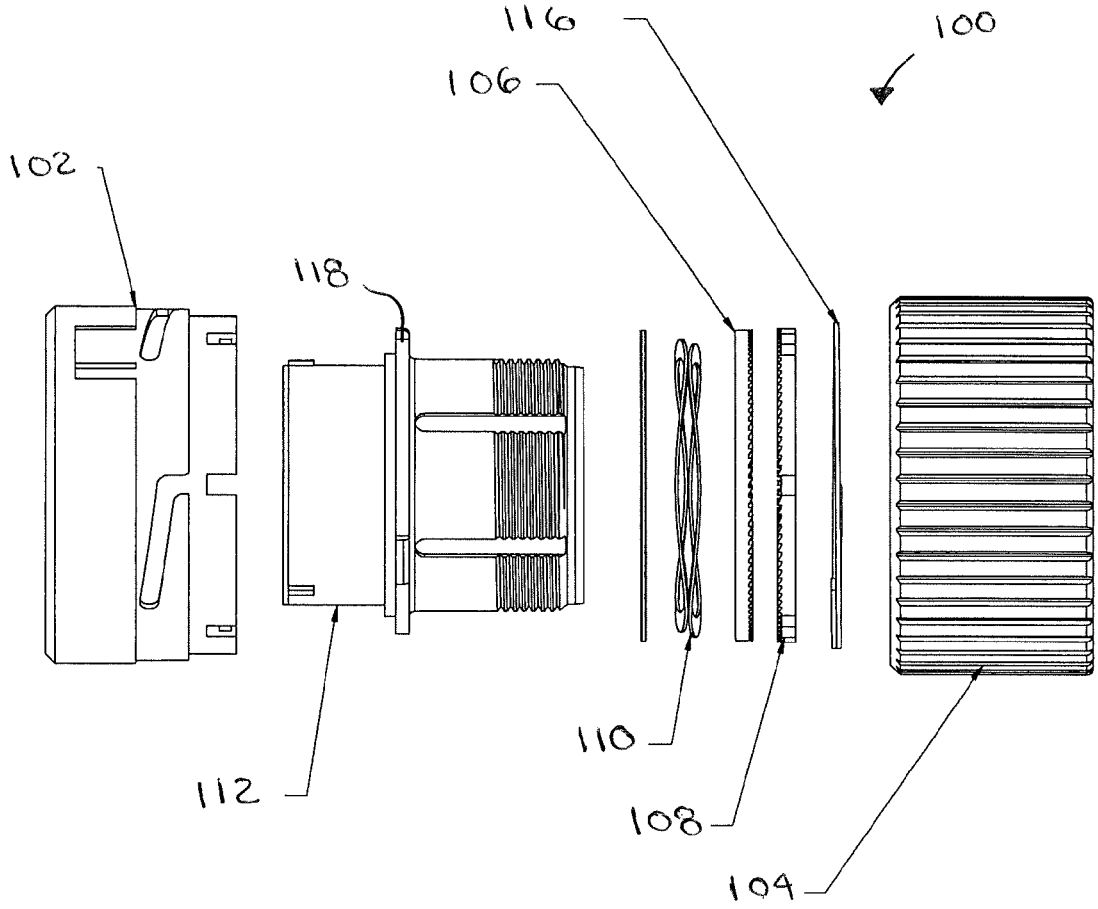
FIG. 1 is an exploded elevational view of a connector coupling according to an exemplary embodiment of the present invention.

Referring to FIGS. 1, 2*a*, 2*b*, 3*a*, 3*b*, 4*a*-4*c*, 5*a*-5*c*, 6*a*, 6*b*, 7*a*, and 7*b*, the present invention relates to an anti-vibration coupling 100 for an electrical connector assembly, such as a plug and receptacle assembly. The coupling 100 preferably provides a secure one-way ratchet engagement such that the connectors of the assembly can only be disengaged manually by moving the coupling 100 between engaged (FIGS. 6*a* and 6*b*) and disengaged (FIGS. 7*a* and 7*b*) positions. Such ratchet engagement substantially prevents the components of the connector assembly from becoming loose, particularly during vibration. The coupling 100 generally includes an inner collar 102, an outer collar 104, first and second ratchet rings 106 and 108, and a biasing member 110, as seen in FIG. 1.

Figure 6A:
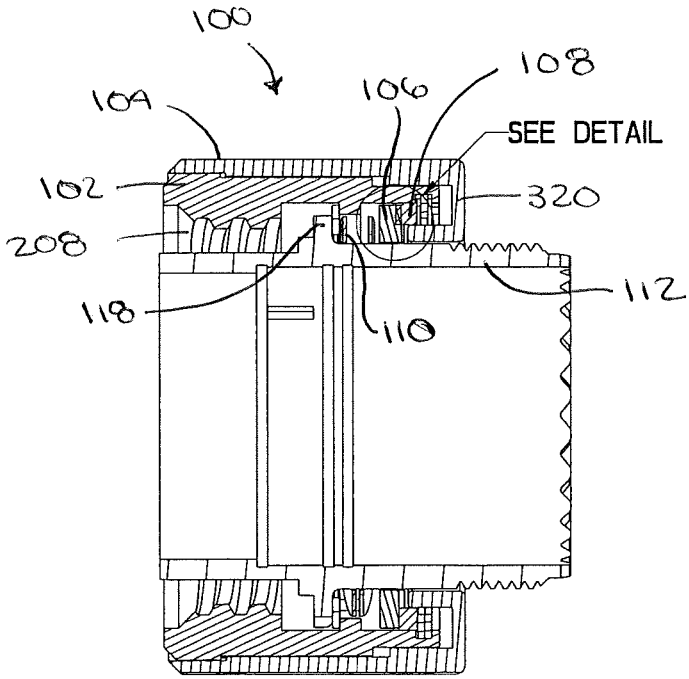
FIG. 6*a* is a cross-sectional view of the connector coupling illustrated in FIG. 1, showing the connector assembled and the first and second ratchet rings engaged.
Figure 7A:
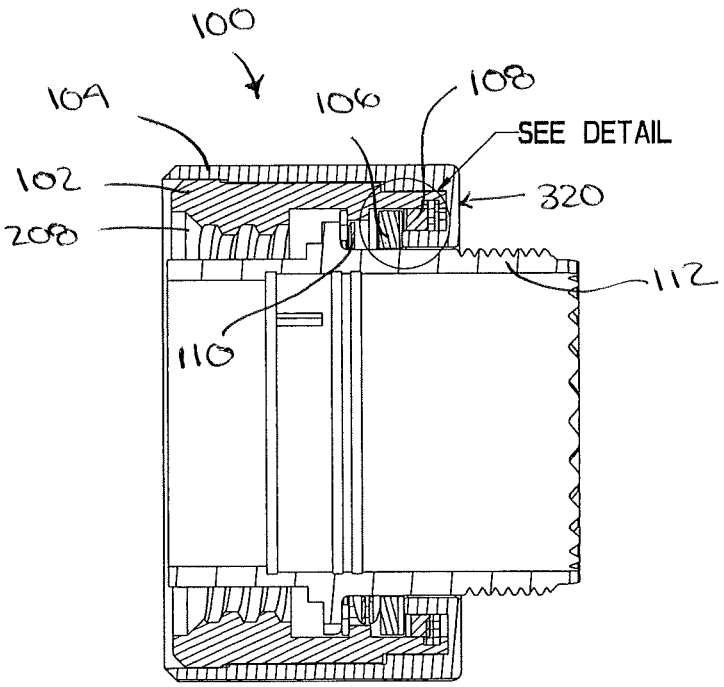
FIG. 7*a* is a cross-sectional view of the connector coupling illustrated in FIG. 1, showing the connector assembled and the first and second ratchet rings disengaged.

The coupling 100 may be disposed on a connector body 112 of one of the components of the connector assembly, as seen in FIGS. 1, 6*a* and 7*a*. For example, the connector body 112 may be the shell of a plug component. In a preferred embodiment, the inner collar 102 of the coupling 100 accepts the connector body 112 and the outer collar 104 of the coupling 100 receives the inner collar 102. The ratchet rings 106 and 108 and the biasing member 110 are preferably disposed on the connector body 112 and between the connector body 112 and the inner and outer collars 102 and 104.

Figure 2A:
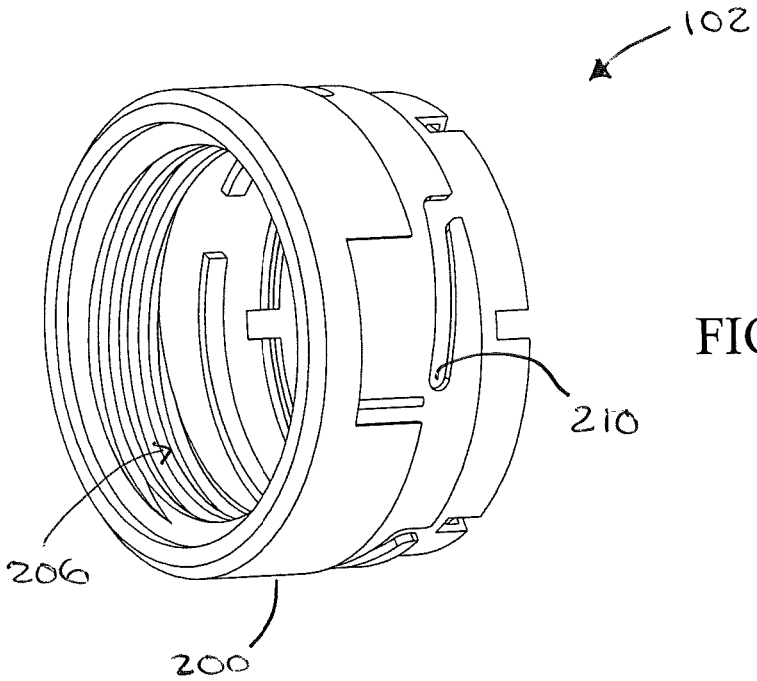
FIG. 2*a* is an perspective view of a first collar of the connector coupling illustrated in FIG. 1.
Figure 2B:
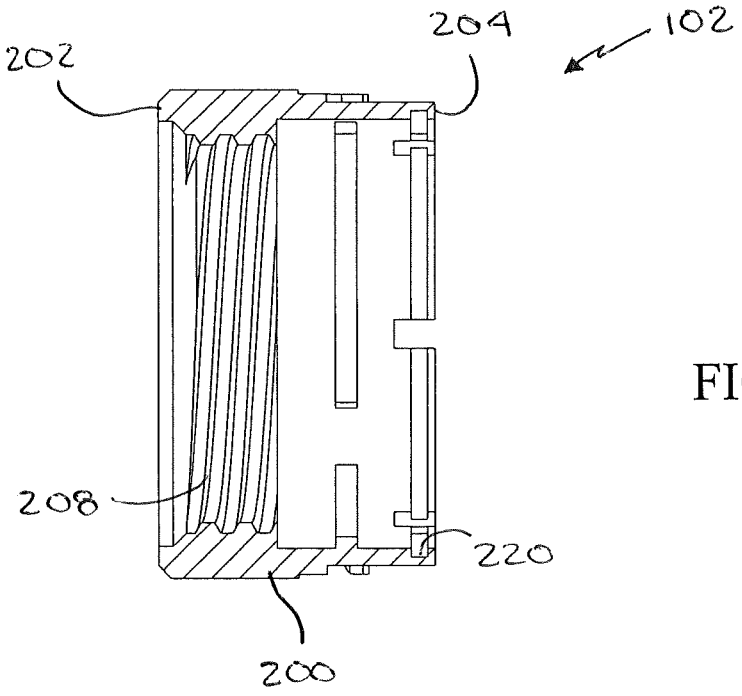
FIG. 2*b* is a cross-sectional view of the first collar illustrated in FIG. 2*a;*

As best seen in FIGS. 2*a* and 2*b*, the inner collar 102 may include a main body 200 with first and second ends 202 and 204 and an inner bore 206 for receiving the connector body 112. The main body 200 preferably has internal threads 208 in the inner bore 206 near the first end 202 thereof for engaging the mating connector (not shown), such as a receptacle. The main body 200 may also include an outer engagement member or members 210 for interlocking the inner and outer collars 102 and 104 together. The outer engagement members 210, may be, for example, bayonet-type channels for receiving corresponding members of the outer collar 104, as best seen in FIG. 2*a*.

Figure 3A:
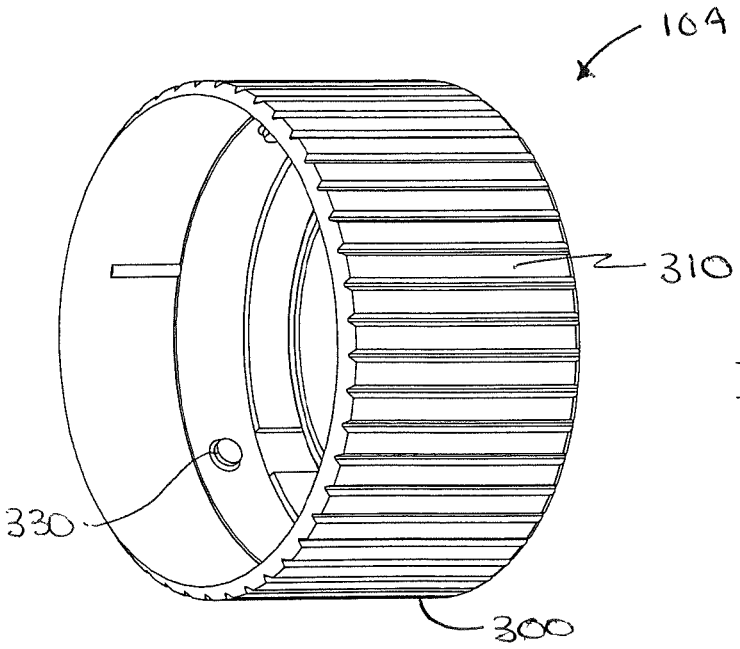
FIG. 3*a* is an end perspective view of a second collar of the connector coupling illustrated in FIG. 1.
Figure 3B:
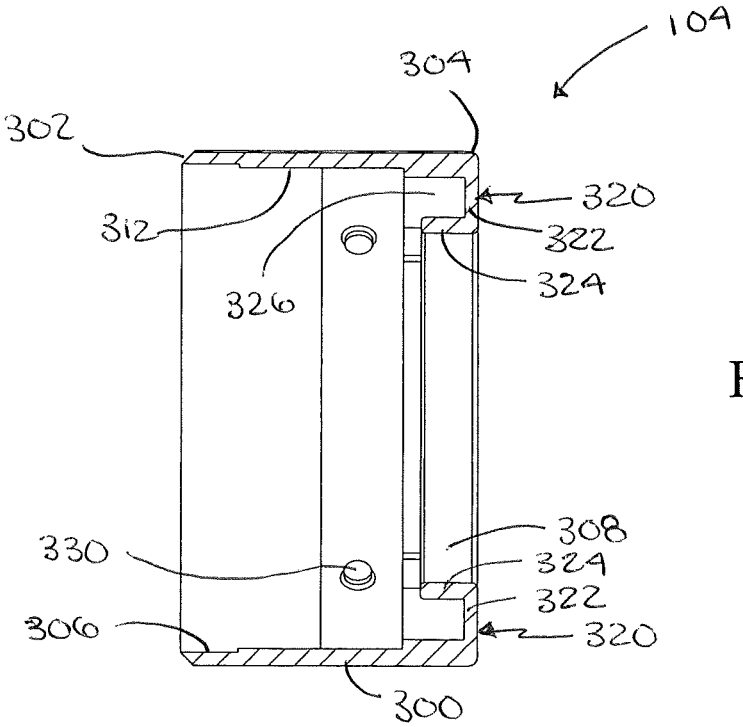
FIG. 3*b* is a cross-sectional view of the second collar illustrated in FIG. 3*a;*

The outer collar 104 surrounds the inner collar 102 to provide a mechanism for manually unlocking the inner collar 102 from the mating connector. The outer collar 104 is designed to slide axially with respect to the inner collar 102 and the connector body 112 between first and second positions. As seen in FIGS. 3*a* and 3*b*, the outer collar 104 generally includes a main body 300 with opposite first and second ends 302 and 304 that define first and second openings 306 and 308, respectively. The first opening 306 is sized to receive the inner collar 104. The second opening 308 is smaller than the first opening 306 and is sized to receive the connector body 102. The main body 300 may include an outer gripping surface 310 to facilitate rotational and axial movement of the outer collar 104.

As best seen in FIGS. 3*b*, 6*a* and 7*a*, the second end 304 of the outer collar 104 includes a disengagement member or members 320 for engaging the first ratchet ring 106 to release the inner collar 102. The disengagement member 320 is preferably a flange 320 that extends inwardly and substantially continuously around a circumference of the second end 304 of the main body 300, as best seen in FIG. 3*b*. The flange 320 preferably has a radially extending portion 322 and a axially extending portion 324 such that the flange 320 is substantially L-shaped in cross-section. Between the portions 322 and 324 of the flange 320 and the inner surface 312 of the collar's main body 300, is a receiving area 326 adapted to receive the second ratchet ring 108 as the outer collar 104 is moved to its second position (FIG. 7*a*).

Extending from the inner surface 312 of the main body 300 is an inner engagement member or members 330 that correspond to the outer engagement member or members 210 of the inner collar 102. The inner engagement members 330 are preferably inwardly extending detents, as seen in FIGS. 3*a* and 3*b*. When the outer collar 104 is in its first position (FIG. 6*a*), its inner engagement members 330 are disengaged from the outer engagement members 210 and thus the outer collar 104 can freely rotate with respect to the inner collar 102. To move to its second position (FIG. 7*a*), the outer collar 104 may be rotated with respect to the inner collar 102 until the inner and outer collars 102 and 104 interlock, thereby moving the outer collar 104 axially with respect to the inner collar 102 and the connector body 112. That is, when the outer collar 104 is rotated to the second position, its inner engagement members 330, such as detents, engage and ride along the outer engagement members 210, such as channels, of the inner collar 102 to interlock the same. A retaining ring 116 prevents the outer collar 104 from separating from the connector body 112.

Figure 4A:
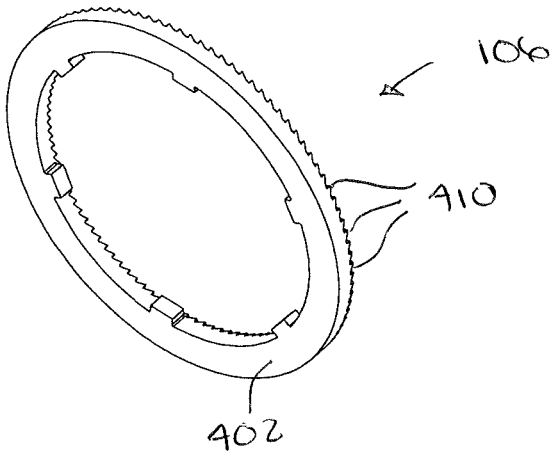
FIG. 4*a* is a perspective view of a first ratchet ring of the connector coupling illustrated in FIG. 1.
Figure 4B:
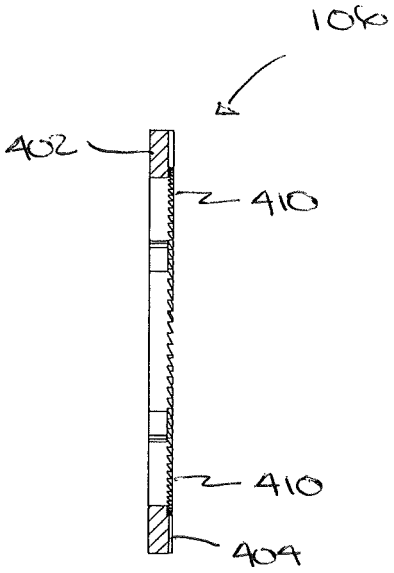
FIG. 4*b* is a cross-sectional view of the first ratchet ring illustrated in FIG. 4*a;*
Figure 4C:
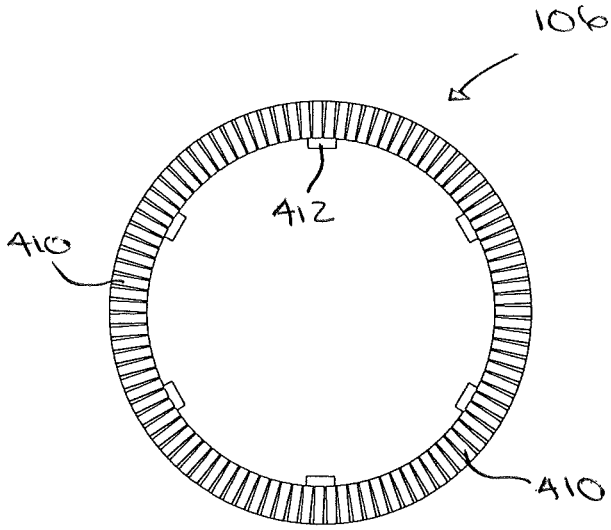
FIG. 4*c* is a side elevational view of the first ratchet ring illustrated in FIG. 4*a;*

As seen in FIGS. 1 and 4*a*-4*c*, the first ratchet ring 106 is supported by the connector body 112 and includes opposing first and second faces 402 and 404. The first ratchet ring 106 is located inside of the inner collar 102 near the second end 204 thereof. One or more locking members 410 extend from the second face 404 of the ring 106 for engaging the second ratchet ring 108. The locking members 410 are preferably a plurality of axially extending ratchet teeth, as best seen in FIG. 4*b*. The first face 402 of the ratchet ring 108 is adapted to abut the biasing member 110, which is located between the first ratchet ring 106 and an outer flange 118 of the connector body 112. The biasing member 110 may be a wave spring, for example. The ratchet ring 108 may include a plurality of spaced radial projections 412 extending inwardly therefrom. The first ratchet ring 106 moves axially with respect to the connector body 112 and the inner collar 102 between engaged (FIG. 6*a*) and disengaged (FIG. 7*a*) positions with the second ratchet ring 108.

Figure 5A:
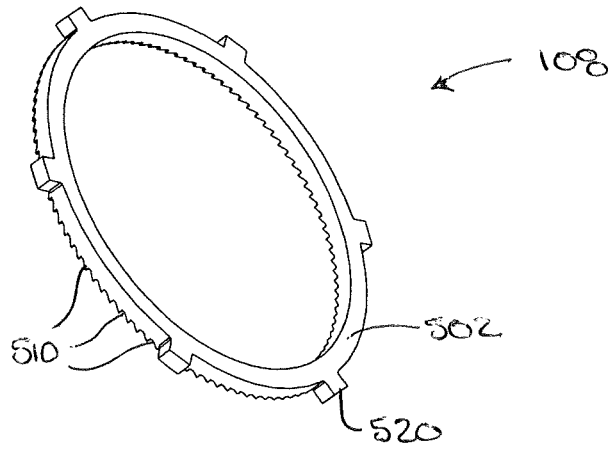
FIG. 5*a* is a perspective view of a second ratchet ring of the connector coupling illustrated in FIG. 1.
Figure 5B:
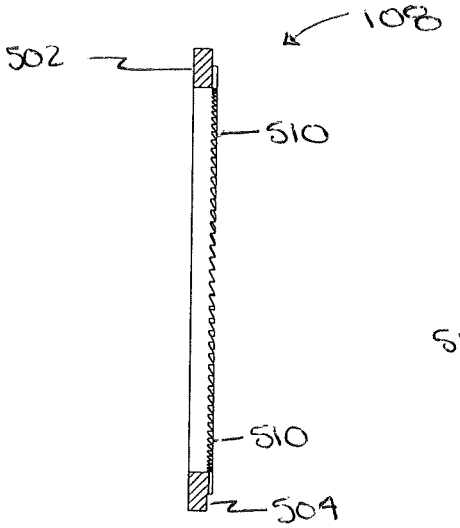
FIG. 5*b* is a cross-sectional view of the second ratchet ring illustrated in FIG. 5*a;*
Figure 5C:
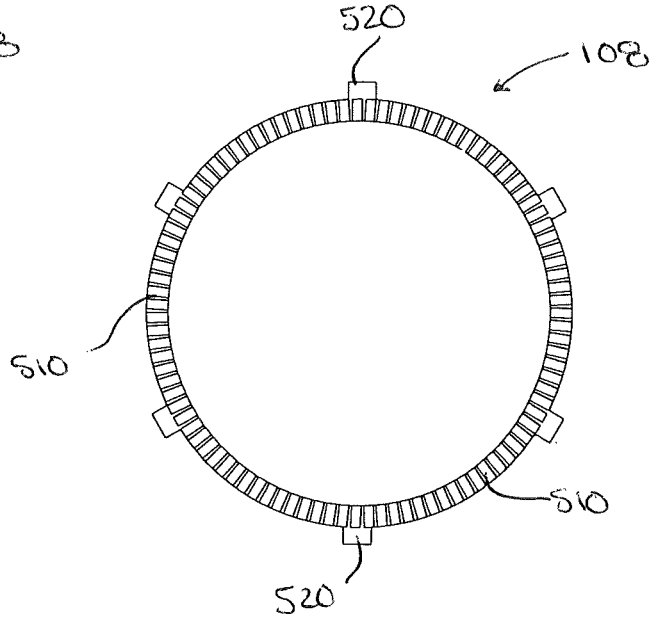
FIG. 5*c* is a side elevational view of the second ratchet ring illustrated in FIG. 5*a;*

As seen in FIGS. 1 and 5*a*-5*c*, the second ratchet ring 108 is preferably stationary with respect to the connector body 112 and the inner and outer collars 102 and 104. The second ratchet ring 108 is preferably fixed to the inner collar 102 in any known manner. For example, radially outwardly extending projections 520 of the second ratchet ring 108, may engage corresponding notches 220 (FIG. 2*b*) of the inner collar 102. As such, the inner collar 102 and the second ratchet ring 108 rotate together. As seen in FIGS. 1 and 5*b*, the second ratchet ring 108 is supported by the connector body 112 and includes opposing first and second faces 502 and 504. The first face 502 includes one or more locking members 510 that correspond to the locking members 410 of the first ratchet ring 108. The one or more locking members 510 are preferably ratchet teeth, as best seen in FIG. 5*b*, that engage the ratchet teeth 410 of the first ratchet ring 106 such that the inner collar 102 can rotate with respect to the connector body 112 one direction and not in the opposition direction.

Figure 6B:
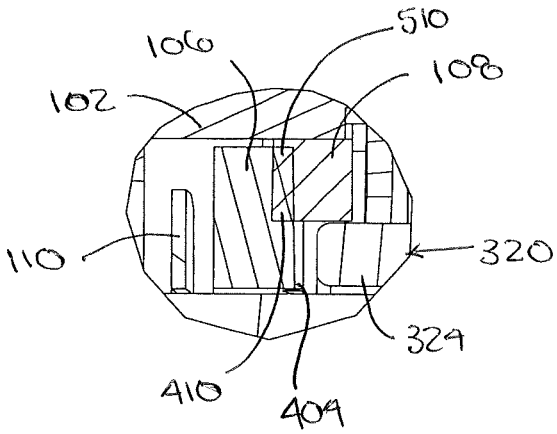
FIG. 6*b* is an enlarged partial view of the assembly of FIG. 6*a;*

FIGS. 6*a* and 6*b* illustrate the coupling 100 in an engaged or locked position wherein the inner collar 102 may be rotated with respect to the connector body 112 in only one direction via ratchet rings 106 and 108. That allows the inner collar 102 to be mated with a mating connector via its internal threads 208 while also preventing that threaded engagement from loosening during vibration. In that position, the teeth 410 and 510 of the first and second ratchet rings 106 and 108, respectively, are engaged in a one-way ratchet engagement. The biasing member 110 pushes the first ratchet ring 106 into engagement with the second ratchet ring 108. In that position, the inner detents 330 of the outer collar 104 are disengaged from the corresponding outer channels 210 of the inner collar 102 such that the inner and outer collars 102 and 104 are not interlocked.

Figure 7B:
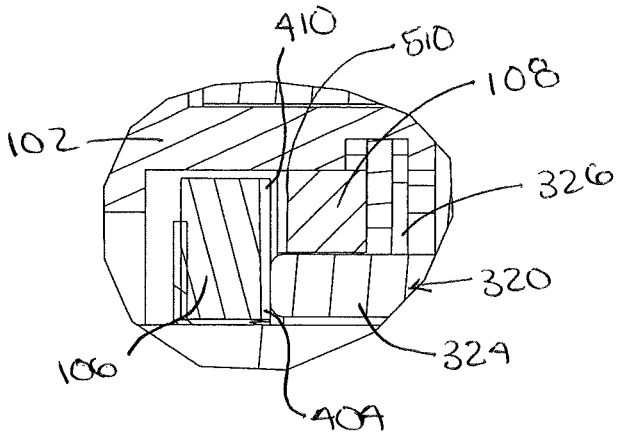
FIG. 7*b* is an enlarged view of a portion of the assembly of FIG. 7*a*.

In order to un-mate the connectors, the ratchet rings 106 and 108 must be manually disengaged using the outer collar 104, as illustrated in FIGS. 7*a* and 7*b*. The outer collar 104 is rotated and moved axially with respect to the inner collar 102 to its second position such that the inner detents 330 of the outer collar 104 engage the outer channels 210 of the inner collar 102. As the outer collar 104 moves axially and interlocks with the inner collar 102 via the detents 330 and the channels 210, the axially extending portion 324 of the disengagement flange 320 of the outer collar 104 pushes against the second face 404 of the first ratchet ring 106. The disengagement flange 320 pushes the first ratchet ring 106 against the bias of the biasing member 110 and moves the first ratchet ring 106 away from the second ratchet ring 108, thereby disengaging the ratchet teeth 410 and 510 thereof. As the flange 320 of the outer collar 104 moves axially, the receiving area 326 of the flange 322 receives the second ratchet ring 108, as seen in FIG. 7*b*. That allows the inner collar 102 to rotate in a release direction such that the internal threads 208 disengage from the mating connector.

While particular embodiments have been chosen to illustrate the invention, it will be understood by those skilled in the art that various changes and modifications can be made therein without departing from the scope of the invention as defined in the appended claims.

What is claimed is:

1. A connector coupling, comprising:

a connector body;

a first collar having opposite first and second ends, said first collar receiving said connector body;

a second collar surrounding said first collar, said second collar being rotatable with respect to said first collar between first and second positions;

a movable ratchet ring supported by said connector body; said movable ratchet ring including at least one locking member; said movable ratchet ring being axially movable with respect to said first collar between engaged and disengaged positions; and a stationary ratchet ring coupled to said first collar, said stationary ratchet ring including at least one locking member corresponding to said at least one locking member of said movable ratchet ring, wherein when said movable ratchet ring is in said engaged position, said locking members of said movable and stationary ratchet rings are engaged, and rotating said second collar from said first position to said second position with respect to said first collar moves said movable ratchet ring to said disengaged position away from said stationary ratchet ring such that said locking members are disengaged, thereby allowing rotation of said first collar with respect to said connector body.

2. A connector coupling according to claim 1, wherein said movable ratchet ring and said stationary ratchet ring include a plurality of locking members.

3. A connector coupling according to claim 2, wherein said locking members of said movable and stationary ratchet rings are axially extending interengaging teeth.

4. A connector coupling according to claim 1, further including a biasing member supported by said connector body adjacent said movable ratchet ring and remote from said stationary ratchet ring, said biasing member biasing said movable ratchet ring in said engaged position.

5. A connector coupling according to claim 1, wherein said movable ratchet ring is located inside said first collar near said second end thereof; and internal threads are disposed near said first end of said first collar.

6. A connector coupling according to claim 1, wherein said second collar includes a disengaging flange that contacts and pushes said movable ratchet ring to said disengaged position when said second collar is rotated from said first to said second position.

7. A connector coupling according to claim 6, wherein said disengaging flange extends radially inwardly from an end of said second collar, thereby defining an opening that is smaller than an opening at an opposite end of said second collar.

8. A connector coupling according to claim 6, wherein said disengaging flange includes a radially extending portion and an axially extending portion such that said disengaging flange is substantially L-shaped in cross-section.

9. A connector coupling according to claim 6, wherein said radially extending portion and said axially extending portion of said disengaging flange define a receiving area therebetween; and said receiving area is adapted to receive substantially an entirety of said stationary ratchet ring when said second collar is in said second position with respect to said first collar.

10. A connector coupling according to claim 6, wherein said disengaging flange extends substantially continuously around a circumference of an end of said second collar.

11. A connector coupling according to claim 1, wherein said first collar includes at least one outer engagement member adapted to engage a corresponding inner engagement member of said second collar such that said inner and outer engagement members are disengaged when said second collar is in said first position and said inner and outer engagement members are engaged when said second collar is in said second position.

12. A connector coupling according to claim 11, wherein said outer engagement member is a bayonet channel and said inner engagement member is a detent.

13. A connector coupling, comprising:

a connector body;

a first collar having opposite first and second ends, said first collar receiving said connector body;

a second collar surrounding said first collar, said second collar being rotatable with respect to said first collar between first and second positions, said second collar including a disengaging member at an end thereof, said disengaging member defining a receiving area;

a movable ratchet ring supported by said connector body; said movable ratchet ring including at least one locking member, said movable ratchet ring being axially movable with respect to said first collar between engaged and disengaged positions, said movable ratchet ring being in contact with said disengaging member of said second collar when in said disengaged position; and a stationary ratchet ring coupled to said first collar, said stationary ratchet ring including at least one locking member corresponding to said at least one locking member of said movable ratchet ring, said stationary ratchet ring being received in said receiving area of said second collar when said second collar is in said second position, wherein rotating said second collar from said first position to said second position with respect to said first collar moves said movable ratchet ring to said disengaged position via said disengaging member of said second collar pushing said movable ratchet ring away from said stationary ratchet ring such that said locking members are disengaged, thereby allowing rotation of said first collar with respect to said connector body.

14. A connector coupling according to claim 13, wherein said disengaging member is an annular flange extending radially inwardly from an end of said second collar.

15. A connector coupling according to claim 14, wherein said flange includes a radially extending portion and an axially extending portion such that said flange is substantially L-shaped in cross-section, said receiving area is defined between said radially and axially extending portions.

16. A connector coupling according to claim 13, wherein said movable ratchet ring and said stationary ratchet ring include a plurality of locking members.

17. A connector coupling according to claim 16, wherein said locking members of said movable and stationary ratchet rings are axially extending interengaging teeth.

18. A connector coupling according to claim 13, further including a biasing member supported by said connector body adjacent said movable ratchet ring and remote from said stationary ratchet ring, said biasing member biasing said movable ratchet ring in said engaged position.

19. A connector coupling according to claim 13, wherein said movable ratchet ring is located inside said first collar near said second end thereof; and internal threads are disposed near said first end of said first collar.

20. A connector coupling according to claim 13, wherein said first collar includes at least one outer engagement member adapted to engage a corresponding inner engagement member of said second collar such that said inner and outer engagement members are disengaged when said second collar is in said first position and said inner and outer engagement members are engaged when said second collar is in said second position.

21. A connector coupling according to claim 20, wherein said outer engagement member is a bayonet channel and said inner engagement member is a detent.

* * * * *